United States Patent [19]

Cooke-Yarborough

[11] 4,077,216

[45] Mar. 7, 1978

[54] STIRLING CYCLE THERMAL DEVICES

[75] Inventor: Edmund Harry Cooke-Yarborough, Abingdon, England

[73] Assignee: United Kingdom Atomic Energy Authority, London, England

[21] Appl. No.: 716,805

[22] Filed: Aug. 23, 1976

[30] Foreign Application Priority Data

Aug. 27, 1975 United Kingdom ..... 35373/75

[51] Int. Cl.[2] ..... F02G 1/04

[52] U.S. Cl. ..... 60/520; 60/525; 62/6

[58] Field of Search ..... 60/520, 524, 525, 648, 60/690, 693; 62/6; 237/12.1, 13

[56] References Cited

U.S. PATENT DOCUMENTS

| | | | |
|---|---|---|---|
| 2,127,286 | 8/1938 | Bush | 62/6 |
| 3,296,808 | 1/1967 | Malik | 62/6 |
| 3,858,802 | 1/1975 | Stobart | 62/6 X |

*Primary Examiner*—Allen M. Ostrager
*Assistant Examiner*—Stephen F. Husar
*Attorney, Agent, or Firm*—Larson, Taylor and Hinds

[57] ABSTRACT

A multi-cylinder Stirling cycle thermal device is provided having free floating piston members arranged without a solid mechanism connected to the piston members to derive power therefrom. The piston members are free to oscillate in the cylinders and define variable volume heat-absorbing and heat-rejecting chambers therein. Heat is arranged to be supplied to some of the heat-absorbing chambers so that the device functions as a Stirling cycle heat engine driving a Stirling cycle heat pump, heat being collected from all the heat-rejecting chambers to provide a heat input for a heating system.

A reciprocating power output may also be provided by a device responsive to pressure changes in the working gas.

17 Claims, 11 Drawing Figures

STIRLING CYCLE THERMAL DEVICES

BACKGROUND TO THE INVENTION

This invention relates to Stirling cycle thermal devices and includes Stirling cycle heat engines and Stirling cycle heat pumps, and is particularly concerned with multi-cylinder Stirling cycle thermal devices.

In the Stirling cycle heat engine, on the application of heat energy to the hot chamber, a quantity of gas is cycled between intercommunicating hot and cold chambers by varying the chamber volumes. The resulting gas temperature changes cause a cyclic pressure variation which can be used to perform mechanical work if the total chamber volume is allowed to vary. The efficiency can be improved if the hot and cold chambers are interconnected through a regenerator which absorbs heat from the gas as it flows towards the cold chamber and replaces this heat when the gas returns.

Stirling cycle heat pumps on the other hand, although operating on the same principles as Stirling cycle heat engines, transfer heat energy from one chamber to the other when mechanical work is done on the gas. It should be noted that the direction of the transfer of heat from the heat intake end is the same whether the device is used as a heat engine or a heat pump. Thus the hot chamber of the heat engine and the cold chamber of the heat pump both absorb heat, heat being transferred in each case to the other chamber whose temperature is that at which the heat is rejected. In the interest of clarity, therefore, those chambers which absorb heat are hereinafter referred to as heat-absorbing chambers and those that reject heat are referred to as heat-rejecting chambers.

It is necessary when designing a Stirling cycle thermal device to achieve a cyclic volume variation in the heat-absorbing and heat-rejecting chambers, and to ensure that the correct phasing is maintained. The phase angle of the chamber which absorbs heat should lead that of the chamber which rejects heat by an angle which depends on the design of the device.

One known multi-cylinder variant of the Stirling cycle heat engine is the Rinia double-acting engine which uses connecting rods and rotating mechanical parts to derive mechanical power from the engine. The present invention seeks to provide a multi-cylinder Stirling cycle thermal device which possesses the thermal efficiency of the Stirling cycle without having the complication of mechanical systems hitherto used for utilising the mechanical power it develops.

SUMMARY OF THE INVENTION

According to one aspect of the present invention a Stirling cycle thermal device comprises a multiplicity of cylinders adapted to contain a working gas; a gas displacement member disposed in each said cylinder and free to oscillate in an axial direction in said each cylinder in response to pressure changes in the working gas therein, said gas displacement member being without a solid mechanism connectable thereto to derive power thereform and interconnect the oscillatory measurements of the gas displacement member with that of the other gas displacement members; a variable volume heat-absorbing chamber defined in each said cylinder between one end of the gas displacement member therein and the respective end of the cylinder; a variable volume heat-rejecting chamber defined in each said cylinder between the other end of the gas displacement member therein and the respective end of the cylinder; regenerator duct means for flow of the working gas therethrough and disposed so as to interconnect the cylinders in series relationship, each said regenerator duct means being connected at one end to a heat-absorbing chamber of a cylinder and at the other end to a heat-rejecting chamber of an adjacent cylinder to form a system adapted to operate with gas displacement and phase relationship on a Stirling cycle, and heating means adapted for heating to a predetermined temperature at least one of the heat-absorbing chambers, in operation, those systems having heat-absorbing chambers heated by said heating means operate as Stirling cycle heat engines and drive the other systems as Stirling cycle heat pumps.

According to another aspect of the present invention, a Stirling cycle thermal device comprises three or more cylinders having variable volume heat-absorbing and heat-rejecting chambers therein, and interconnected in series by regenerator duct means such that the variable volume heat-rejecting chamber of one cylinder is interconnected through a regenerator duct means to the variable volume heat-absorbing chamber of an adjacent cylinder to form a system, each cylinder being adapted to contain a working gas and having a gas displacement member disposed therein capable of oscillating therein to cause gas displacement and define said variable volume chambers between the ends of the cylinder and the respective end of the gas displacement member, and means provided for heating one or more but not all of the cylinders at their heat-absorbing chambers, the gas displacement members being capable of oscillating independently of one another except that the parameters of the device, including the number of cylinders, the masses of the gas displacement members, the elasticity of the working gas, and the volume of the regenerator ducts, are so arranged and tuned that in operation the gas displacement member(s) in said one or more cylinders is/are caused to oscillate with gas displacement between variable volume heat-absorbing and heat-rejecting chambers interconnected thereto at an operational frequency and phase relationship such that each heat-absorbing chamber in said one or more cylinders and the heat-rejecting chamber interconnected thereto constitutes a system operating as a Stirling cycle heat engine and drives as Stirling cycle heat pumps adjacent systems having unheated heat-absorbing chambers.

According to a further aspect of the present invention, a Stirling cycle thermal device comprises three or more cylinders having variable volume heat-absorbing and heat-rejecting chambers therein, and interconnected in series by regenerator duct means such that the variable volume heat-absorbing chamber of one cylinder is interconnected through a regenerator duct means to the variable volume heat-rejecting chamber of an adjacent cylinder to form a system, each cylinder being adapted to contain a working gas and having a free floating piston member disposed therein slidable so as to be capable of oscillating therein to cause gas displacement and define said variable volume heat-absorbing and heat-rejecting chambers between the ends of the cylinder and the respective end of the piston member, the piston members being capable of oscillating independently of one another except that the parameters of the device, including the number of cylinders, the masses of the piston members, the elasticity of the working gas, and the volume of the regenerator ducts, are so arranged and tuned that on the application of heat to the heat-absorbing chamber(s) of one or more cylinders the piston member(s) in said one or more cylinders is/are caused to oscillate with gas displacement from said one or more cylinders between interconnected variable volume heat-absorbing and heat-rejecting chambers at an operational frequency and phase relationship such that the heat absorbing chamber(s) in said one or more cylinders and the heat-rejecting chamber(s) to which they are interconnected constitute a system operating as a Stirling cycle heat engine and drive as Stirling cycle heat pumps adjacent systems having unheated heat-absorbing chambers.

There may be provided power output means adapted to be responsive to the pressure fluctuations in the working gas, as the working gas flows between adjacent cylinders and to provide a reciprocating output from said pressure fluctuations, said adjacent cylinders having variable volume heat-absorbing chambers arranged to be heated to said predetermined temperature in operation of the device.

Preferably, means are provided for heating the heat-absorbing chambers of said one or more cylinders.

Desirably in all aspects of the invention, in operation, heat rejected by each of the heat-rejecting chambers is combined to provide a heat output to a heating system.

In one form of the invention, the device comprises four cylinders or whole multiples of four cylinders.

In another form of the invention, the device comprises three cylinders or whole multiples of three cylinders.

As used herein, "free floating" means free of any substantial mechanical restraint in the direction of oscillation and so that the piston members are capable of oscillating independently of one another without a solid mechanism connected to the piston members and interrelating the oscillatory movements of the piston members either with one another or to a mechanical device outside the cylinders.

BRIEF EXPLANATION OF THE DRAWINGS

To enable the present invention to be more readily understood attention is directed by way of example only to the accompanying drawings, in which.

DETAILED DESCRIPTION OF THE INVENTION

Figure 1:
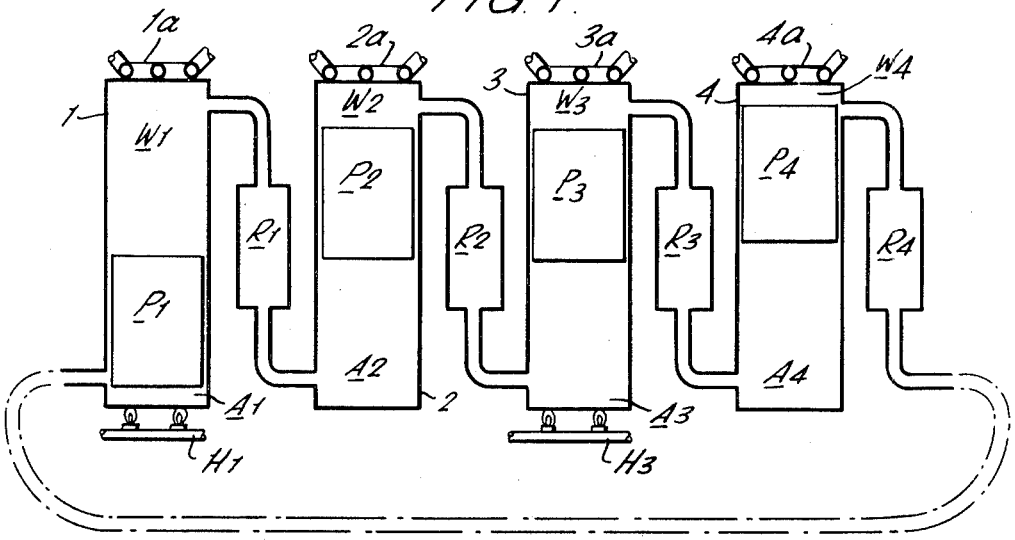
FIG. 1 shows in diagrammatic median section a Stirling cycle thermal device having four cylinders.

Referring now to FIG. 1, the Stirling cycle thermal device shown comprises four cylinders 1 to 4 respectively having gas displacement members in the form of free floating pistons P1 to P4 respectively disposed therein. The pistons P1 to P4 are slidable within their respective cylinders so as to be capable of oscillating therein and define heat-absorbing and heat-rejecting variable volume chambers A1, W1 to A4, W4 respectively at each end of the cylinders 1 to 4 between the respective pistons P1 to P4 and the ends of the cylinders 1 to 4 respectively. The cylinders 1 to 4 are arranged in series so that the heat-rejecting variable volume chamber of one cylinder (e.g. W1) is interconnected by a regenerator duct R1 to R4 respectively to the heat-absorbing variable volume chamber (e.g. A2) of an adjacent cylinder to form a system operating on a Stirling cycle. The cylinders 1 to 4 respectively each contain a working gas (e.g. helium) which is cycled between the interconnected variable volume heat-rejecting and heat-absorbing chambers (e.g. W1, A2) by the pistons P1 to P4 through the regenerator ducts R1 to R4 respectively which absorb heat from the gas as it flows towards the cooler variable volume chambers and replaces this heat when the gas returns to the warmer chambers. The pistons P1 to P4 are made a close clearance fit within the cylinders 1 to 4 respectively, or alternatively "Ferrofluid" seals may be used between the cylindrical wall of the pistons P1 to P4 respectively and the inside of the cylinders 1 to 4 respectively as shown in FIG. 1*a* to which reference may be made.

Figure 1A:
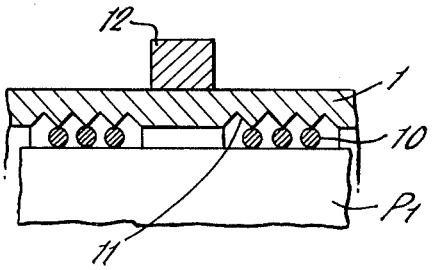
FIG. 1*a* shows to an enlarged scale in fragmentary median section, a diagrammatic representation of a Ferrofluid seal incorporated in one of the cylinders shown in FIG. 1.

In FIG. 1*a*, bands 10 of a magnetic fluid (Ferrofluid) are retained between the tips of serrations 11 on the inside cylindrical surface of the cylinder 1 and the wall of the piston P1 by the attraction exerted by a magnet 12 of annular form disposed symmetrically between the serrations 11 outside the cylinder 1 to seal the gap between the portion P1 and the cylinder 1.

Referring again to FIG. 1, the parameters of the device, including the mass of the pistons P1 to P4 respectively, the elasticity of the working gas, the the volume of the regenerator ducts R1 to R4, are arranged so that if a heating source is applied to the end of each heat-absorbing chamber A1 to A4 respectively, for example an oil burner $H_1 \ldots H_4$ (only H1, H3 being shown) the gas reaching these chambers A1 to A4 expands causing the pistons P1 to P4 to oscillate leading to cyclic volume variations of the heat-rejecting and heat-absorbing variable volume chambers W1 to W4 and A1 to A4 respectively so that the device operates as a Stirling cycle heat engine in a manner similar to the known Rinia Stirling Cycle heat engine except that unlike the Rinia engine no connecting rods and rotating parts are provided to derive the mechanical power of the engine as a mechanical output. With no means shown of abstracting mechanical power from the device, the oscillation amplitude would continue to rise until limited by mechanical constraint on piston movement.

If instead of heating all the heat-absorbing chambers, alternate heat absorbing chambers (e.g. A1, A3) are heated and others remain unheated, the device will continue to operate as an engine but the amplitude will rise more slowly.

The pressure/volume relationship in the cylinders 1 to 4 respectively will still be such that both the heated and the unheated cylinders 1 to 4 will continue to pump heat from their heat absorbing chambers A1 to A4 to their heat rejecting chambers W1 to W4 respectively. Consequently the temperatures at the ends of the unheated heat-absorbing chambers (e.g. A2, A4) will fall below ambient temperature and heat will be pumped from the environment to the heat-rejecting chambers W1, W3. Those systems of the device operating as a Stirling cycle heat engine (e.g. A1 - W4, A3 - W2) therefore cause cyclic volume variations in the heat-absorbing and heat-rejecting chambers (A2 - W1, A4 - W3) of the other systems which are thereby driven as heat pumps without the complications of mechanical connecting rods and cranks. Heat may be absorbed from the heat-rejecting chambers (W1 - W4) by a heat transfer liquid (e.g. water) in copper tubes 1*a* - 4*a*.

When the device (assumed to be ideal) is in equilibrium, all the mechanical power produced by the heated systems (e.g. A1 - W4, and A3 - W2) goes to drive the unheated systems (A2 - W1, and A4 - W3), heat being rejected by all the cylinders 1 to 4 at their warm chambers W1 to W4 respectively.

In an ideal system, the useful heat output from all the heat-rejecting chambers (W1 to W4) should be much higher than the heat applied to the heated heat-absorbing chambers A1, A3 and although heat losses in the device reduce the efficiency of the heat output at the heat-rejecting chambers W1 to W4, the device should still produce a heat output to the heat transfer liquid in the tubes 1*a* . . . 4*a* for use in a heating system greater than the heat produced by the fuel (e.g. oil) used to heat the heat-absorbing chambers (A1, A3), and may therefore be used as a heat enhancer.

Figure 1B:
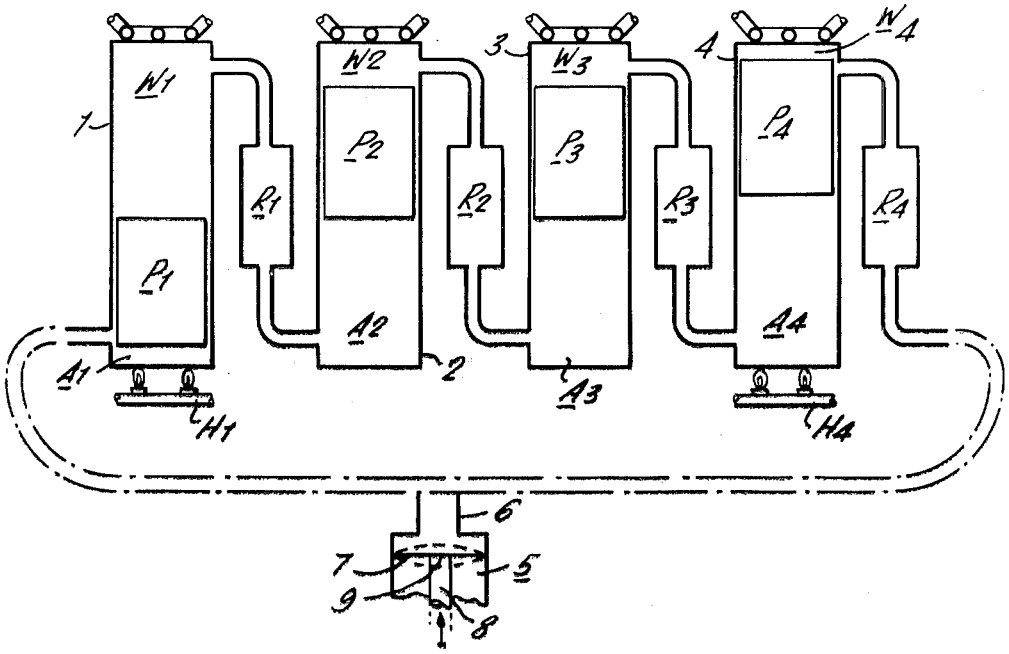
FIG. 1*b* shows the device of FIG. 1 modified to incorporate a power output means.

Mechanical power may be extracted, for example, as shown in FIG. 1*b* to which reference is now made. In FIG. 1*b* the Stirling cycle thermal device show is identical to that shown in FIG. 1 except that the heating source is shown at H1 and H4 and a cavity in the form of a cylinder 5 is connected by a "Tee" pipe 6 to the gas flow path between cylinders 4 and 1. A resilient diaphragm 7 (e.g. stainless steel) is held in sealed engagement at its periphery in the cylinder 5 and presents one side to the gas flow so as to be responsive to pressure fluctuations in the gas.

A rod 8 has one end 9 connected to the centre of the other side of the diaphragm 7 and extends axially therefrom, whilst the other end (not shown) of the rod 8 is connected to a power absorber (not shown), for example, the armature of a moving iron alternating current generator.

In operation when for example heat-absorbing chambers A1 and A4 are heated (as shown) the diaphragm 7 oscillates under the action of fluctuations in the gas pressure as a result of the oscillatory movement of the pistons P1 and P4, and the corresponding reciprocating movement of the rod 8 provides a power output to a power absorber. Systems A2 - W1 and A3 - W2 may still be driven as heat pumps.

Figure 2A:
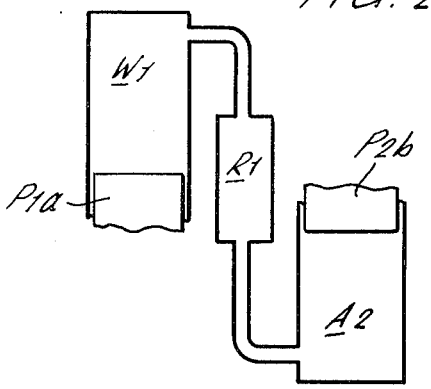
FIG. 2*a* shows a fragmentary part of the device shown in FIG. 1.
Figure 2B:
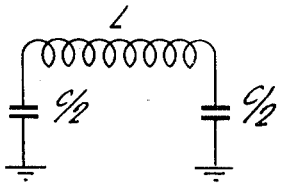
FIG. 2*b* shows an electrical representation of that part of the device shown in FIG. 2*a;*

Part of the device shown in FIG. 1 constituting a system is shown in FIG. 2*a* to which reference is now made, and shows a heat-rejecting chamber (e.g. W1) and the top half of its piston P1*a*, and the heat-absorbing space (e.g. A2) to which it is interconnected, and its corresponding lower piston half P2*b*, and this system may be treated as one Stirling cycle engine. Such an arrangement at a uniform temperature can be represented electrically by the electrical network shown in FIG. 2*b*, and referring to FIG. 2*b* the two capacitors C/2 represent the masses of the half pistons P1*a* and P2*b*, and the inductance L represents the elasticity of the gas between them. Current in the inductor L corresponds to gas pressure and the voltages on the capacitors C/2 correspond to piston (P1*a*, P2*b*) velocity, so the energy stored in the capacitors C/2 corresponds to the kinetic energies of the half pistons P1*a*, P2*b*.

Figure 2C:
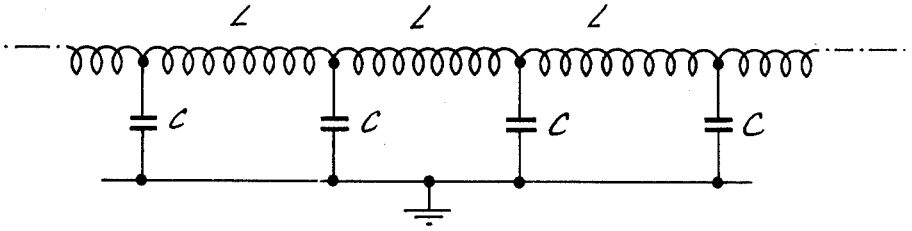
FIG. 2*c* shows electrically part of an infinite number of the electrical representation of FIG. 2*b* connected in series.

The arrangement of an infinite number of such Stirling cycle engines interconnected as shown in FIG. 1 but at uniform temperature corresponds to an infinite electrical constant -k low-pass filter network, four sections of which are shown in FIG. 2*c* to which reference may be made. Such a filter has a cut-off frequency of $1/\pi\sqrt{LC}$, and has zero attennuation below this frequency (see "Wave Filters" by L. C. Jackson — a Methuen monograph). At a frequency of $1/\pi\sqrt{2LC}$, the phase lag between opposite ends of any one section is 90°. Because the interconnected volumes are exposed to opposite sides of successive pistons a phase-reversal takes place and the heat-absorbing volumes (e.g. A2 of FIG. 2*a*) will be advanced 90° in phase with respect to the heat-rejecting volumes (e.g. W1 of FIG. 2*a*) with which they are interconnected. This is the phase difference desirable between hot and cold chambers for Stirling cycle operation. When heat is applied to a heat-absorbing chamber, the volume of the hot chamber leads that of the colder chamber in phase, gas pressure slightly leads total gas volume in phase, and heat is withdrawn from the heat-absorbing chamber to do mechanical work. If the phase is reversed, then heat is pumped from the colder space to the warmer one and mechanical power is absorbed.

If the 4-section electrical network in FIG. 2*c* has its right-hand end connected back to its lefthand end, and the system is at uniform temperature, the impedances and phase shifts are the same as for an infinite network and any disturbance introduced at any part of the network will propagate round and round the network in both directions at a frequency of $1/\pi\sqrt{2LC}$. Since any harmonics of this frequency will be above the cut-off frequency of the network, they will rapidly be attenuated and a sinusoidal oscillation results. If now the heat-absorbing chambers A1 to A4 of all the cylinders 1 to 4 respectively of the equivalent Stirling engine shown in FIG. 1 are heated, a disturbance propagated from left to right will be enhanced, absorbing energy from the heat source, while a disturbance propagated from right to left will be attenuated as it attempts to pump heat from the warm chambers W1 to W4 to the hotter chambers A1 to A4. Thus the systems in the device will operate with 90° between the movements of individual pistons P1 to P4 as though the pistons were linked together via connecting rods and crankshafts except that since the system is unloaded the amplitudes of oscillation of the pistons P1 to P4 would increase continuously until limited mechanically.

Assuming now that the heat-absorbing chambers (e.g. A1, A2) of successive cylinders 1, 2) are warmer and colder respectively than their interconnected heat-rejecting chambers (W4, W1) then a disturbance propagated from left to right will be alternately enhanced and attenuated. If however, the heated systems develop more power than the unheated systems absorb, disturbances propagating from left to right will be enhanced and oscillation will be maintained. Heat will be pumped from both heated and unheated heat-absorbing chambers A1 to A4 and rejected from all the heat-rejecting chambers W1 to W4, thereby providing a Stirling cycle heat engine without the complication of mechanical linkages.

Figure 3:
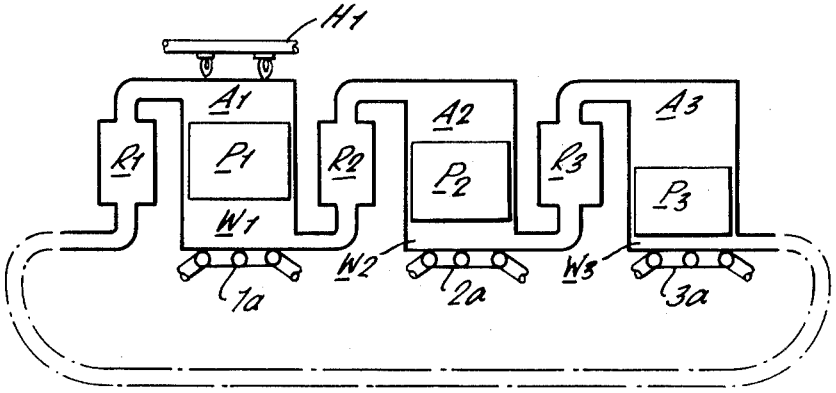
FIG. 3 shows a device similar to that of FIG. 1 but having three cylinders.

A three cylinder Stirling cycle thermal device may be operated and analysed similarly with a phase lag of 120° between pistons at a frequency of $1/\pi\ 4/3\ \sqrt{LC}$. The phase difference between successive interconnected chambers will be 120° - 180° : a phase advance of 60°. An example of a three cylinder Stirling cycle thermal device is shown in FIG. 3 to which reference may be made, and apart from the omission of cylinder 4, with its piston P4 and regenerator R4, and the use of one heating source H1, is similar to the device shown in FIG. 1.

The above analysis is also applicable to devices incorporating whole multiples of four or three cylinders with one or more heated cylinders to obtain the desired phase 1 g of 90° or 120° respectively.

It will be appreciated that the phase angle of the power section and the phase angle of the heat pump section may be adjusted by slight adjustment of the piston masses to eliminate any slight impedance mismatch between the power and heat pump sections.

A further alternative arrangement provides that, for example, one of the systems "idles", in that the temperature at both ends (the heat-absorbing chamber and the heat-rejecting chamber) is maintained at the temperature at which heat is rejected by the other systems, the function of the "idler" system being to provide a required phase shift.

Considering now the temperature at the heat rejecting chamber for several alternative heating arrangements in an ideal heat engine driving an ideal heat pump both having full Carnot efficiency: If there are '*m*' power systems and '*n*' heat pump systems, then when the device is in equilibrium:

$$\left(\frac{TH}{TW}\right)^m \times \left(\frac{TC}{TW}\right)^n = 1$$

where

TH = temperature of the heating source
TW = temperature at the heat rejecting chamber
TC = ambient temperature For a four-cylinder device with two systems heated:

$$TW = \sqrt{TH\ TC}$$

For a three cylinder device with one system heated:

$$TW = (TH\ TC^2)^{\frac{1}{3}}$$

For a three cylinder device with one system heated, and one idling (both ends at TW):

$$TW = \sqrt{TH\ TC}$$

For a four cylinder device with only one system heated:

$$TW = (TH\ TC^3)^{\frac{1}{4}}$$

If $$TH = 600°\ C$$

$$TC = 0°\ C$$

| Arrangement No. | No. of Cylinders | No. of Engine Systems | No. of heat Pump Systems | No. of Idler Systems | TW° C |
|---|---|---|---|---|---|
| A | 3 | 1 | 2 | 0 | 129 |
| B | 3 | 1 | 1 | 1 | 215 |
| C | 4 | 2 | 2 | 0 | 215 |
| D | 4 | 1 | 3 | 0 | 92 |

Losses in a practical device would make the actual heat output temperatures (TW) lower than those calculated for the ideal lossless device considered above. A practical heating arrangement may be required to deliver heat in the temperature range 60° C to 100° C, so that Arrangements 'A' and 'D' would appear to be most suitable for such applications at a heat source temperature (TH) of about 600° C, depending on the effective losses and the temperature of the low temperature heat source (TC). By the use of solar heating, TC may be raised to about 30° C, for example, to minimise the rise in temperature required to TW.

A combined Stirling cycle heat engine and heat pump according to the invention may have its cylinders disposed in varying orientations relative to one another since there is no solid mechanical connection between the oscillating pistons. As the combined Stirling cycle heat engine and heat pump is totally enclosed there is no need for gas seals on, for example, mechanical members extending through the cylinders and conventionally used to derive or transmit mechanical power from or to Stirling cycle thermal devices, which reduces frictional losses and simplifies maintenance.

The invention has been described in relation to the example shown in FIG. 1 in a simplified form, and known features such as heat exchangers may be incorporated in a practical construction of a Stirling cycle thermal device incorporating the invention. As an alternative to free floating pistons, a piston may be supported on, and sealed for example by a diaphragm with suitable mass loading to give the desired operating frequency or, as described in co-pending application No. 16178/75, by a stack of such diaphragms arranged in the manner of a bellows as shown in FIG. 4 to which reference is now made.

Figure 4:
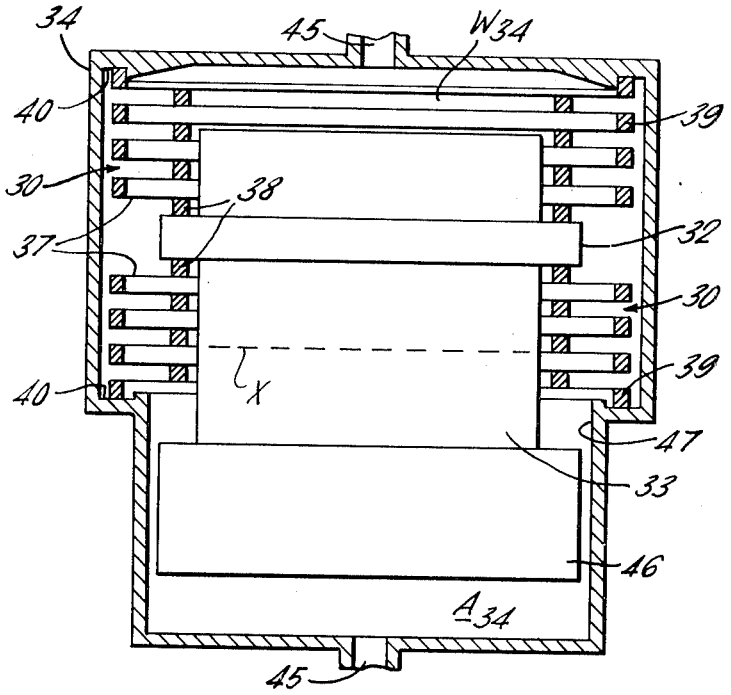
FIG. 4 shows to an enlarged scale in median section a sealing arrangement in the form of a stack of diaphragms between a piston member and a cylinder for use in the devices shown in FIG. 1 and FIG. 3.

In the arrangement shown in FIG. 4, two stacks of diaphragms 30 locate co-axially each side of a flange 32 around a piston member 33 in a cylinder 34 of stepped hollow cylindrical form. Each stacks of diaphragms 30 comprises seven flat annular metal diaphragms 37 stacked one above the other and articulated in series in an alternate manner by square cross-section rings 38 and 39 of elastomeric material, such as rubber, bonded thereto at the inner and outer peripheries respectively of the diaphragms 37. The inner rubber ring 38 at one end of each stack of diaphragms 30 is bonded to the respective side of the flange 32, and the outer rubber ring 39 at the other end of the stack of diaphragms 30 is bonded in a groove 40 at the respective end of the cylinder 34, and the stepped portion of the cylinder 34. Ports 45 at each end of the cylinder 34 permit gas flow through regenerator ducts (not shown) to respective adjacent cylinders in the series. The heat absorbing chamber in the cylinder is indicated by A34, and the heat rejecting chamber by W34. The piston member 33 has an enlarged end 46 adjacent to the heat-absorbing chamber W34, and provides a heat shield for the stack of diaphragms 30, particularly the inner and outer rubber rings 38, 39. When the cylinder 34 is operating as a heat pump, the variable volume heat-absorbing chamber A34 being unheated or at a lower temperature than the heat-rejecting chamber W34, the enlarged portion 46 of the piston member 33 may be omitted and the piston member 33 terminated on the broken line "X".

In operation as part of the aforedescribed multi-cylinder Stirling cycle thermal device, the piston member 33 oscillates as a "free floating" piston under the resilient location provided by the stack of diaphragms 30 which also separates the gas in the heat-absorbing chamber A34 from that in the heat rejecting chamber "34 without requiring a close tolerance sealing member around the periphery of the piston member 33; the clearance between the enlarged end 46 and the side wall 47 of the cylinder 34 may be relatively large. The stack of diaphragms 30 may be arranged to be of relatively light construction so that the "free floating" characteristic of the piston member 33 is not impeded to any substantial extent by a restraining force in the direction of oscillation. The double stack arrangement is shown, as the outside of the stack of diaphragms 30 should not be exposed to the working volume of gas, since the movement of gas in and out of the outer spaces between diaphragms 37 is in anti-phase with the movement of the piston member 33.

There will be some cyclic gas flow between the working volume of the chambers A34, W34, and the space below the flat ends of the piston member 33. By marking the piston member 33 cross-sectional area slightly smaller than the effective area of the diaphragms 37, in-phase pressure changes could be generated below the ends of the piston member 33 which would equal the in-phase component of gas pressure in the working space of the chambers A34, W34. Gas flow to and from the volume below the ends of the piston members 33 would then be restricted to the quadrature component. If this gas flow is found adversely to affect performance to a significant extent, it could be eliminated by introducing a "Ferrofluid" seal around the piston member 33 below the ends thereof in a similar manner to the "Ferrofluid" seal shown in FIG. 1*a*.

The substantially "free floating" piston member 33 may be made self-starting because of the absence of any substantial static friction to overcome between the piston member 33 and the cylinder 34 or any other mechanical support structure.

The metal diaphragms may be made for example from stainless steel and the elastomeric rings 38, 39, from rubbers such as natural rubber, neoprene, silicone, or polyacrylate rubber.

Figure 4A:
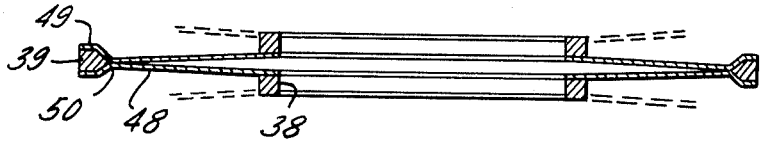
FIG. 4*a* shows to an enlarged scale in median section an alternative diaphragm arrangement for use in the sealing arrangement of FIG. 4.

In order to reduce the internal unswept volume between adjacent diaphragms 37, alternative diaphragm shapes may be used, for example, as shown in FIG. 4*a* in which frusto-conical shaped diaphragms 48 are shown in pairs with their cavities adjacent. Each diaphragm 48 is shaped near its outer periphery to provide a rim 49 bonded to the adjacent side of the outer rubber ring 39 inserted between the pairs of diaphragm 48, whilst the outer edge 50 of the cone-shaped portion of the diaphragm 48 is arranged to be approximately on a median line through the ring 39 normal to the longitudinal axis thereof. In operation pairs of diaphragms 48 deflect towards each other although their swept volume is only about a half that provided by the flat diaphragms 37.

Figure 4B:
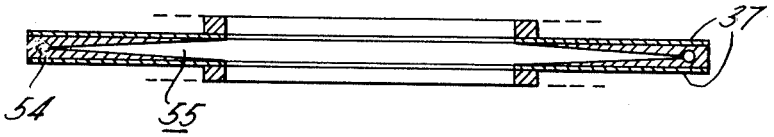
FIG. 4*b* shows to an enlarged scale in median section another alternative diaphragm arrangement for the sealing arrangement of FIG. 4.

Another alternative arrangement but providing a greater swept volume is shown in FIG. 4*b* to which reference is now made. The stack 30 may now comprise composite diaphragms 53 formed by two flat diaphragms 37 having a layer 54 of rubber extending from their outer peripheries and bonded to their adjacent faces. The layer 54 is provided with an opening 55 of tapered cross-section which reduces with increasing diameter. Adjacent composite diaphragms 53 are bonded at their inner peripheries to an inner rubber ring 38, both the rubber layer 54 and inner rubber ring 38 being bonded to the diaphragms 37 at the same time. If desired similar rubber layers 54 may be used at the inner peripheries of the diaphragms 37 instead of the inner rubber ring 38.

It will also be appreciated that "cylinder" is used in a mechanical sense to define a cavity containing a fluid in which a piston member reciprocates and includes cavities of non-circular cross-section.

Figure 5:
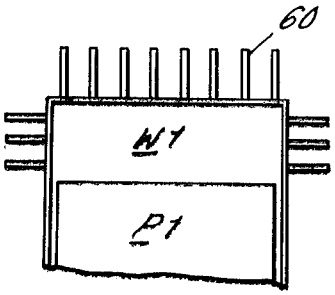
FIG. 5 shows to an exaggerated scale a fragmentary sectional view of the heat-rejecting end of one of the cylinders of FIG. 1.

Alternative means of deriving a power ouput from any of the aforedescribed devices may be used provided that no mechanical structural members are introduced that require to extend through the wall of a cylinder to connect to a piston member therein, otherwise the free floating characteristic of the piston member will be adversely affected. Alternative heating means H1 . . . H4 may be used for example as gas burners. Alternative means for absorbing heat from the heat-rejecting chambers may be used such as heat transfer fins to absorb and transfer the heat to an air stream forming part of a heating system as shown in FIG. 5 to which reference is made and in which heat transfer fins 60 are shown around the outside of heat-rejecting chamber W1.

The variable volume chambers may extend and include a portion of the regenerator ducts in which heat exchangers may be disposed.

We claim:

1. A Stirling cycle thermal device comprising, a multiplicity of cylinders adapted to contain a working gas; a gas displacement member disposed in each said cylinder and free to oscillate in an axial direction in said each cylinder in response to pressure changes in the working gas therein, said gas displacement member being without a solid mechanism connectable thereto to derive power therefrom and interconnect the oscillatory movements of the gas displacement member with that of the other gas displacement members; a variable volume heat-absorbing chamber defined in each said cylinder between one end of the gas displacement member therein and the respective end of the cylinder; a variable volume heat-rejecting chamber defined in each said cylinder between the other end of the gas displacement member therein and the respective end of the cylinder; and regenerator duct means for flow of the working gas therethrough and disposed so as to interconnect the cylinders in series relationship, each said regenerator duct means being connected at one end to a heat-absorbing chamber of a cylinder and at the other end to a heat-rejecting chamber of an adjacent cylinder to form a system adapted to operate with gas displacement and phase relationship on a Stirling cycle, said device further comprising heating means for heating to a predetermined temperature the heat-absorbing chamber of at least one said system, with at least one further said system having a heat-absorbing chamber unheated by said heating means, so that in operation of the device, the at least one said system having the heat-absorbing chamber thereof heated by said heating means operates as a Stirling cycle heat engine and drives the at least one further said system having the heat-absorbing chamber thereof unheated by said heating means as a Stirling cycle heat pump.

2. A device as claimed in claim 1 and further comprising power output means arranged to be responsive to the pressure fluctuations of the working gas as said gas flows between adjacent cylinders and adapted to provide a reciprocating output from said pressure fluctuations, said adjacent cylinders having heat-absorbing chambers arranged to be heated by the heating means.

3. A device as claimed in claim 2, wherein the power output means, comprises a cavity open to the working gas, a resilient disc sealingly attached to the sides of the cavity such that it presents a side exposed to the gas pressure, and means for connecting the other side of the disc to a power absorbing means.

4. A device as claimed in claim 1, wherein at least one of the heat-absorbing chambers, not heated to said predetermined temperature is adapted to absorb heat from a source at ambient temperature.

5. A device as claimed in claim 4, wherein means are provided for absorbing the heat rejected at all the heat-rejecting chambers and are adapted to provide a heat input for a heating system.

6. A device as claimed in claim 4, wherein the device comprises three cylinders.

7. A device comprising a whole multiple of devices as claimed in claim 6, the regenerator means being arranged to interconnect the devices in series relationship to form a single interacting device.

8. A device as claimed in claim 4, wherein the device comprises four cylinders.

9. A device comprising a whole multiple of devices as claimed in claim 8, the regenerator means being arranged to interconnect the devices in series relationship to form a single interacting device.

10. A device as claimed in claim 8, wherein two of the heat-absorbing chambers are adapted to absorb heat at ambient temperature.

11. A device as claimed in claim 1, wherein the heat-absorbing chamber and the heat-rejecting chamber of a system are arranged to be maintained substantially at a temperature at which heat is rejected at the heat rejecting chambers in adjacent systems, thereby to introduce a predetermined phase shift in the operation of the device.

12. A Stirling cycle heat engine and heat pump comprising, three or more cylinders adapted to contain a working gas; a piston member disposed in each said cylinder and slidable therein so as to oscillate axially to cause gas displacement and define a variable volume heat-absorbing chamber at one end of each said cylinder and a variable volume heat-rejecting chamber at the other end of each said cylinder, the piston members being free floating in the cylinders so as to be capable of oscillating independently of one another without an interconnecting mechanism; sealing means provided between the side of each piston member and the inside surface of the respective cylinder to hermetically separate the heat-absorbing and heat-rejecting chambers in said respective cylinder without introducing to any substantial extent a restraining force on the oscillatory movement of the piston member; and regenerator duct means for flow of gas therethrough connecting the heat-absorbing chambers of the cylinders to the heat-rejecting chambers of adjacent cylinders so that the cylinders are interconnected in series by the regenerator duct means; heating means adapted for heating to a predetermined temperature at least one of the heat-absorbing chambers; each of the other heat-absorbing chambers being adapted to absorb heat from a source at a lower temperature than the heat-rejecting chamber to which said each other heat-absorbing chamber is interconnected; and heat-absorbing means adapted to absorb heat rejected at all the heat-rejecting chambers and provide a heat input for a heating system; said at least one heat-absorbing chamber and interconnected heat-rejecting chamber thereof operating as a Stirling cycle heat engine and driving each of said other heat-absorbing chambers and interconnected heat-rejecting chamber thereof as Stirling cycle heat pumps.

13. A device as claimed in claim 12, wherein the sealing means comprises a pair of sealing devices disposed co-axially one behind the other, each sealing device comprising, a plurality and an odd number of annular-shaped metal plates stacked one behind the other, each plate being made from a metal which is resiliently flexible but of sufficient stiffness to be at least self-supporting and having a bore greater than the adjacent diameter of the piston member; outer annular members of elastomeric material bonded to adjacent plates throughout the stack in an alternate manner at their outer peripheries; and inner annular members of elastomeric material bonded to adjacent plates throughout the stack at their inner peripheries in an alternate manner and in staggered relationship to the outer annular members; the sealing devices being arranged so that the inner annular members are adjacent and are bonded to the piston member at one end thereof, and the outer annular members at the other end of the sealing devices are bonded to the cylinder.

14. A device as claimed in claim 13, wherein the plates are substantially of frusto-conical form and are disposed in pairs with their cavities adjacent.

15. A device as claimed in claim 13, wherein elastomeric material is disposed between adjacent plates so as to fill the internal volume unswept between said adjacent plates during the oscillatory movement of the piston member.

16. A device as claimed in claim 13, wherein a portion of the cylindrical surface of the piston member near the heat-absorbing chamber is of an enlarged diameter so as to provide a heat shield between the heat absorbing chamber and the sealing means, the cylinder being shaped to accomodate said enlarged portion of the piston member.

17. A device as claimed in claim 12, wherein the sealing means comprises several bands of magnetic fluid, the same number of circumferential serrations on the inside surface of the cylinder, and a magnet means circumferentially disposed around the cylinder and positioned to locate the bands to the serrations by magnetic attraction.

* * * * *